United States Patent [19]

Haase

[11] 4,236,052

[45] Nov. 25, 1980

[54] DEAD MAN SWITCH FOR A WINCH

[75] Inventor: Reinhold A. Haase, Hastings, Nebr.

[73] Assignee: Dutton-Lainson Company, Hastings, Nebr.

[21] Appl. No.: 958,423

[22] Filed: Nov. 7, 1978

[51] Int. Cl.[3] ..... H01R 33/54

[52] U.S. Cl. ..... 200/51.09; 200/51 R; 200/336; 339/41

[58] Field of Search ..... 254/186 R, 150 R, 166; 200/51.09, 51 R, 51.1, 51.11, 51.12, 153 K, 153 S, 155 R, 155 A, 157, 336; 339/41, 19; 318/379, 549, 552, 553, 558, 54 R; 242/54 R, 86.5 R, 106

[56] References Cited

U.S. PATENT DOCUMENTS

| | | | |
|---|---|---|---|
| 3,339,039 | 8/1967 | Daley | 200/51.09 |
| 3,467,359 | 9/1969 | Durand | 254/186 R X |
| 3,581,181 | 5/1971 | Wallace | 318/379 X |
| 4,135,068 | 1/1979 | Burns | 200/157 X |

*Primary Examiner*—John M. Jillions

*Attorney, Agent, or Firm*—Allegretti, Newitt, Witcoff & McAndrews

[57] ABSTRACT

A reversible direct current, winch motor is controlled by a "dead man" switch. The switch includes a handle pivotally attached to a plug and normally maintained in a neutral position relative to the plug. The plug is received in a receptacle defined in the winch housing. Leads in the receptacle from the motor are normally shunted to provide a winch braking effect. Directional pivotal movement of the switch handle causes power leads in the handle to pivot and engage the motor leads and thereby provide subsequent directional operational of the motor. The handle and plug, as well as the power input leads, are removable from the receptacle for safety and security purposes.

13 Claims, 5 Drawing Figures

DEAD MAN SWITCH FOR A WINCH

BACKGROUND OF THE INVENTION

This invention relates to an improved switch construction for use in combination with a motor-driven winch. Winch devices are typically utilized in recreational equipment such as in association with boat trailers for hauling a boat onto a trailer or releasing a boat from a trailer. Winches have additional uses such as pulling or moving loads.

Typically, a boat trailer winch is mounted at one end of the boat trailer. An electric motor or a hand crank is provided to drive a gear train which, in turn, rotates a cable drum and thereby controls the winding or unwinding of a cable attached to the boat upon the drum. Often a direct current, reversible motor is used in order to permit winding or unwinding of cable from the drum. An auto or truck battery may serve as the power source for such a motor.

When the winch is not being operated, it is desirable to disconnect the power source from the winch for purposes of security and safety. When the winch is in operation, it is desirable to have an easily operated control mechanism for operation of the winch.

The present invention relates to an improved switch arrangement for use in combination with a motor-driven winch wherein the switch permits reversible control of a direct current winch motor as well as removal of the switch for storage and security when the winch is not needed. The switch construction incorporates a "dead man" feature which maintains the switch in a neutral position when it is released.

SUMMARY OF THE INVENTION

Briefly, the present invention comprises a switch in combination with a winch wherein the switch includes a receptacle attached to the winch frame or housing and having projecting motor contact leads. The receptacle is cooperative with a housing or plug that may be inserted into and removed from the receptacle. A pivotal handle is incorporated as part of the housing and includes power leads which are normally maintained in a neutral position. The power leads may be manually pivoted for appropriate engagement with the contact leads associated with the receptacle. Shunt mechanisms are provided for shunting the leads to the motor when the switch is in the neutral position thereby providing a braking effect. The power leads and control handle are removable from the winch and receptacle during periods of non-use of the winch thereby providing a security and safety feature.

Thus, it is an object of the present invention to provide an improved winch construction having an improved electrical switch associated therewith.

A further object of the present invention is to provide an improved switch for a winch, said switch having a neutral position and two control positions to thereby control a reversible direct current motor.

A further object of the present invention is to provide a switch mechanism for an electric winch which includes shunt means for shunting the coils of the motor to thereby produce a braking effect.

Still a further object of the present invention is to provide an improved switch construction which is economical to manufacture and reliable. Additionally, such a switch should be easy to use.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
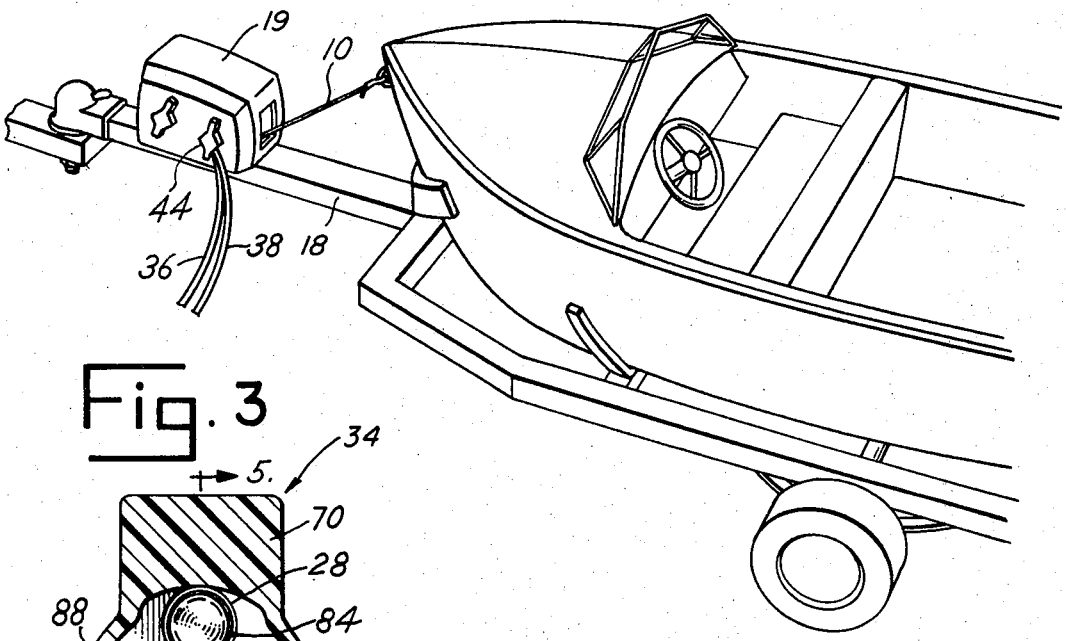
FIG. 1 is a perspective view of a typical winch construction incorporating the improved switch mechanism of the present invention.
Figure 3:
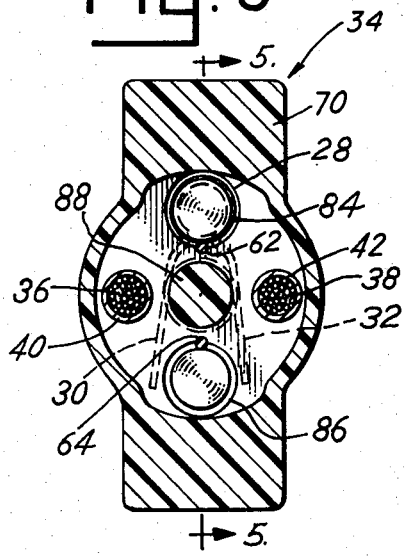
FIG. 3 is a cross sectional view of the rotational components of the switch of the present invention illustrating the switch in the neutral position.

FIG. 1 illustrates a typical winch device incorporating the switch of the present invention. The winch includes a cable 10 wound on a drum (not shown). The drum is driven by a gear train (not shown) which, in turn, is driven by a reversible, direct current motor (not shown). The drum, gear train and motor are all mounted on a support bracket or frame (not shown) which may be attached to a boat trailer 18 or to some other base from which the winch will be operative.

The subject matter of the present invention relates to the electrical switch mechanism associated with the described winch. The switch mechanism of the invention includes a receptacle 20 which is integrally incorporated with a cover 19 for the winch. First and second conductor pins 22 and 24 project from the base of the receptacle 20. The pins 22 and 24 constitute leads for the direct current motor (not shown) within the cover 19. The pins 22 and 24 are insulated from the bracket 18 so that power through the pins 22 and 24 may be provided to the motor without causing a short circuit.

Pin 22 includes a circumferential groove 26 at its base. A U-shaped shunt wire 28 engages the groove 26 to maintain the wire 28 in position on the pin 22. Legs 30 and 32 of wire 28 are normally biased into electrical contact with the pin 24. Wire 28 thus shunts the motor to provide an internal braking effect to the winch.

Power is provided to the leads or pins 22 and 24 through a plug assembly 34 illustrated in FIGS. 2–5. The plug assembly 34 includes power leads or wires 36 and 38 which may be connected with any conventional power source such as a battery. The leads 36 and 38 are inserted into contact bushings 40 and 42 respectively.

The lead wires 36 and 38 extend into a manually operable handle 44. The bushings 42 and 44 project through passages 46 and 48 defined in a contact support member 50 attached to the handle 44. The bushings 40 and 42 project through plate 51, cylindrical projection 53 and beyond the forward planar surface 52 of projection 53 of member 50. The bushings 40 and 42 are generally parallel to a rotation axis 54 of handle 44.

A U-shaped shunt wire 56 is also inserted through appropriate parallel openings 58 and 60 in the member 50. The legs 62 and 64 project beyond the surface 52 to the forward end of axial stub 66. It is noted that bushings 40 and 42 project to the same extent through openings 46 and 48. The legs 62 and 64 are arranged normally at the 12 o'clock and 6 o'clock positions with respect to the axis 54 whereas the bushings 40 and 42 are arranged respectively at the 9 o'clock and 3 o'clock positions. These are the normal neutral positions associated with the switch prior to any manual rotation of the handle 44 and attached components.

A plug member 68 is comprised of a hollow housing 70 and a rear flange plate 72. The housing 70 receives the cylindrical projection 53 of member 50 through the annular opening 74 in flange plate 72. The opening 74 is sized so that the diameter of the opening 74 is substantially equal to the diameter of the cylindrical projection 53. The rear flange plate 72 rests against plate 51 of member 50. The depth of housing 70 is equal to the maximum projection of the stub 66 from the plate 51.

A biasing spring 76 has its opposite ends 78 and 80 engaged respectively with plate 68 and plate 51 so as to normally bias the plug member 68 to a neutral or "dead man" position with respect to the handle 44 and other components forming the plug assembly 34. A cover plate 82 fits over the flange plate 72 and is secured to the handle 44 to retain the described components together as a completed plug assembly. It is to be noted then that the plug member 68 is the only component of the plug assembly 34 which is rotatable with respect to the remaining components of the assembly 34. The opening 83 of cover plate 82 is shaped to limit the rotation of the member 68.

The housing 70 includes first and second openings positioned at the 12 o'clock and 6 o'clock positions with respect to the axis 54. The openings 84 and 86 respectively are positioned to receive the pins 22 and 24 respectively when the housing 70 is inserted into the receptacle 20. The shape of the housing 70 with respect to the receptacle 20 insures proper alignment (keying) of the component parts comprising the plug assembly 34 with respect to the housing 20.

Also upon such insertion of the housing 70, a wedge projection 88 extending forwardly along the axis 54 from the housing 70 engages and spreads the legs 30 and 32 of shunt wire 28 thereby disengaging the shunt wire from the pin 24. Simultaneously, the pins 22 and 24 engage the legs 62 and 64 of the shunt wire 56 so as to maintain the shunted circuit through the motor.

Figure 4:
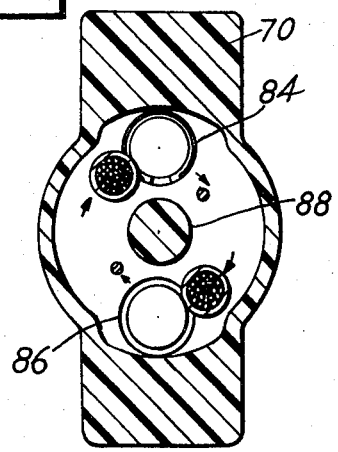
FIG. 4 is a cross sectional view similar to FIG. 3 wherein the switch has been rotated in a clockwise sense to operate an associated direct current motor in a first sense.
Figure 5:
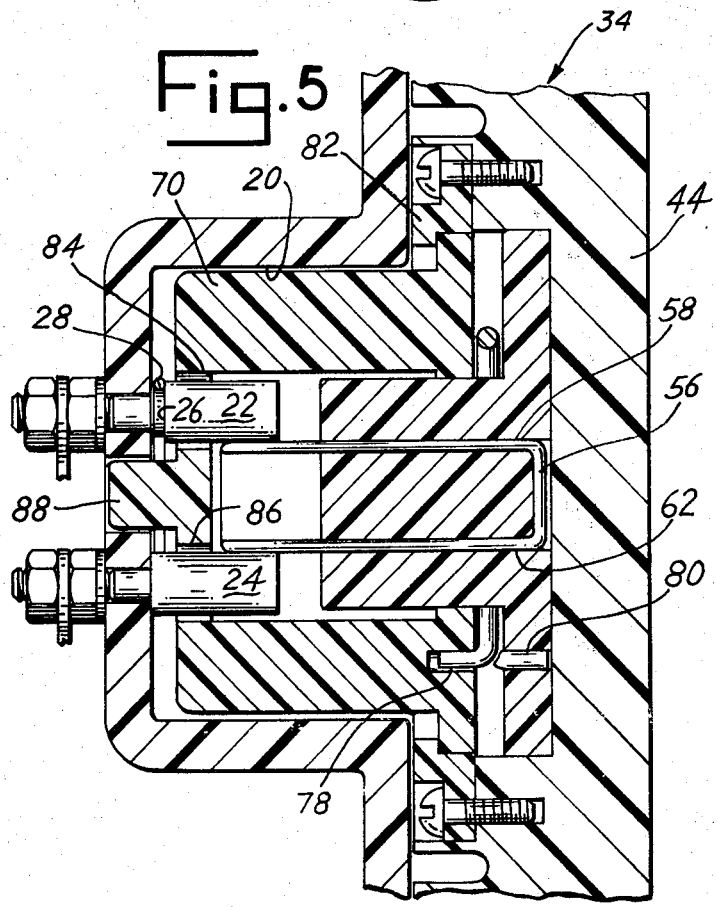
FIG. 5 is a cross sectional view transverse to FIG. 3.
Figure 2:
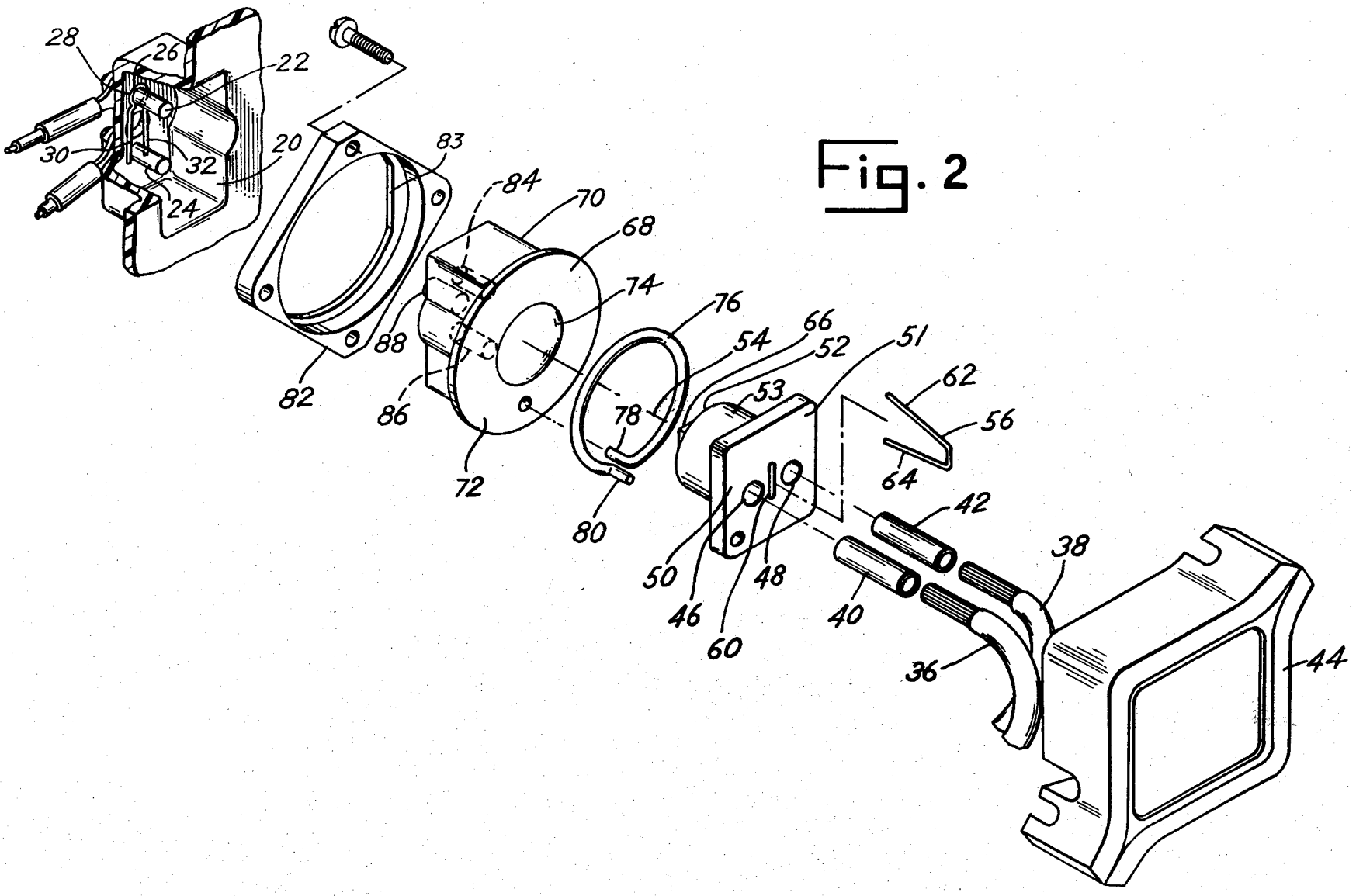
FIG. 2 is an exploded perspective view of the improved switch mechanism associated with the present invention.

Upon rotation of the handle 44 the pins 22 and 24 are disengaged from the legs 62 and 64 since legs 62 and 64 are rotated simultaneously with handle 44. As illustrated in FIG. 4 the handle 44 may be rotated in the clockwise or counterclockwise direction about the axis 54. Sufficient rotation in either direction will cause the bushings 40 and 42 to be rotated into contact with the pins 22 and 24. Thus, rotation of the handle 44 in the clockwise direction causes bushing 40 to engage pin 22 and bushing 22 to engage pin 24. This will cause the direct current motor 16 to operate in a first sense. Operation of the motor 16 in the opposite sense is effected by rotation by the handle 44 in the opposite direction or counterclockwise direction causing bushing 42 to engage pin 22 and bushing 40 to engage pin 24.

It will be noted that when the handle 44 is in the neutral position, the motor is shunted. When the plug assembly 34 is removed from the receptacle 20 the motor is shunted. The motor is not shunted when bushings 40 and 42 engage pins 22 and 24.

When it is necessary to stow the winch, the plug assembly 34 is removed. This promotes safety and security. Since the receptacle 20 may be integrally molded as part of a shroud or cover 19 for the winch, the cover has a dual purpose of providing safety from operation of the mechanical parts of the winch and serving as a receptacle for the plug assembly 34.

Therefore, while there has been set forth a preferred embodiment of the invention, it is to be clearly understood that the invention is limited only by the following claims and their equivalents.

What is claimed is:

1. An improved switch mechanism for the leads to a motor comprising in combination:

a motor lead mounting bracket receptacle having motor leads as parallel projections;

removable bracket engaging means, said bracket engaging means including a plug cooperative with the receptacle and a rotatable power lead handle pivotally attached to the plug, and parallel power leads affixed to the handle for engaging and contacting the motor leads when the plug is engaged to the receptacle and the power lead handle is simultaneously rotated to position the leads in electrical contact said handle being rotatable in either rotational sense to effect switch operation.

2. The improvement of claim 1 including means for keying the bracket engaging plug to the mounting bracket receptacle.

3. The improvement of claim 1 including shunt means connecting the motor leads whenever the bracket engaging means is disengaged from the bracket.

4. The improvement of claim 1 including a shunt wire attached to one of the motor leads and normally biased into engagement with another motor lead, said plug including a shunt wire engaging means to disconnect the wire from the other motor lead upon insertion of the plug into the receptacle.

5. The improvement of claim 1 including a shunt wire mounted in the plug for shunting the motor leads when said plug is inserted into the receptacle and said power leads are maintained in a non-rotated position, said shunt wire being disengaged from the motor leads upon rotation of the power leads.

6. The improvement of claim 1 including biasing means connected between the handle and the plug for biasing the handle to a neutral position.

7. The switch of claim 1 wherein the handle is pivotal about an axis and is rotatable in both a clockwise and a counterclockwise direction about the axis to effect switching between the power leads and motor leads.

8. An improved switch mechanism comprising, in combination:

a receptacle having first and second projecting, parallel leads;

a removable housing for receipt by the receptacle, said housing including a handle pivotally attached thereto, said handle including first and second power leads;

means for normally maintaining the handle in a neutral pivotal position with respect to the housing whereby the power leads are maintained separated from the receptacle leads when the housing is inserted into the receptacle;

shunt means in the housing for engaging the receptacle leads when the handle is in the neutral position and means for disengaging the shunt means upon pivotal movement of the handle from the neutral position.

9. The switch of claim 8 including additional shunt means connecting the receptacle leads when the housing is removed from the receptacle.

10. The switch of claim 8 wherein said shunt means comprise a conductor mounted in the handle for pivotal movement therewith.

11. The switch of claim 8 wherein said handle is pivotal in either rotational sense.

12. The switch of claim 8 wherein means for maintaining the handle in a neutral position comprise spring means interposed between the housing and handle, and said handle includes contact means connected with an external power source, said contact means being carried by the handle and connectable to the receptacle leads upon pivotal movement of the handle.

13. The switch of claim 12 wherein the handle is pivotal about an axis generally at an equal radial distance from the leads and from the contact means.

* * * * *